US011007783B2

(12) United States Patent
Kashiwagi

(10) Patent No.: US 11,007,783 B2
(45) Date of Patent: May 18, 2021

(54) APPARATUS FOR DISCHARGING LIQUID, METHOD FOR MAINTAINING LIQUID DISCHARGE HEAD, AND CLEANER FOR LIQUID DISCHARGE HEAD

(71) Applicant: Yuta Kashiwagi, Kanagawa (JP)

(72) Inventor: Yuta Kashiwagi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/478,941

(22) PCT Filed: Apr. 5, 2018

(86) PCT No.: PCT/JP2018/014609
§ 371 (c)(1),
(2) Date: Jul. 18, 2019

(87) PCT Pub. No.: WO2018/190244
PCT Pub. Date: Oct. 18, 2018

(65) Prior Publication Data

US 2020/0039229 A1 Feb. 6, 2020

(30) Foreign Application Priority Data

Apr. 11, 2017 (JP) ..... JP2017-078118

(51) Int. Cl.
*B41J 2/165* (2006.01)

(52) U.S. Cl.
CPC ..... *B41J 2/16535* (2013.01)

(58) Field of Classification Search
CPC . B41J 2/16547; B41J 2/16535; B41J 2/16508
See application file for complete search history.

(56) References Cited

U.S. PATENT DOCUMENTS 6,176,567 B1 * 1/2001 Uno ..... G03G 15/346 347/22
6,213,582 B1 * 4/2001 Uchida ..... B41J 2/16508 347/33

(Continued)

FOREIGN PATENT DOCUMENTS

CN 101462399 A 6/2009
CN 102046390 A 5/2011

(Continued)

OTHER PUBLICATIONS

Combined Chinese Office Action and Search Report dated May 29, 2020, in Patent Application No. 201880024251.X, 10 pages (with English Translation of Category of Cited Documents).

(Continued)

*Primary Examiner* — Lam S Nguyen
(74) *Attorney, Agent, or Firm* — Oblon, McClelland, Maier & Neustadt, L.L.P.

(57) ABSTRACT

A problem to be solved is to allow adhered substances to be removed from a bead. An apparatus (1) tor discharging liquid, the apparatus (1) comprising: a liquid discharge head (122) to discharge liquid; a holder (111) to hold a liquid application target (400) to which the liquid is applied; and a cleaner (601) to clean the liquid discharge head (122), wherein the cleaner (601) is detachably attached to the holder (111), and wherein, with the cleaner (601) attached to the holder (111) being in contact with the liquid discharge head (122), the holder (111) and the liquid discharge head (122) are relatively moved to clean the liquid discharge head (122) with the cleaner (601).

14 Claims, 33 Drawing Sheets

(56) References Cited

U.S. PATENT DOCUMENTS

| | | | | |
|---|---|---|---|---|
| 2003/0122892 | A1* | 7/2003 | Lim | B41J 2/16535 347/33 |
| 2004/0165031 | A1 | 8/2004 | Nishi et al. | |
| 2005/0093951 | A1 | 5/2005 | Takatsuka et al. | |
| 2007/0040864 | A1 | 2/2007 | Jung et al. | |
| 2008/0007592 | A1 | 1/2008 | Watanabe | |
| 2008/0231656 | A1 | 9/2008 | Kim | |
| 2008/0278538 | A1 | 11/2008 | Tokuno | |
| 2009/0179954 | A1* | 7/2009 | Silverbrook | B41J 2/16547 347/33 |
| 2015/0062240 | A1 | 3/2015 | Kraus et al. | |
| 2015/0306879 | A1 | 10/2015 | Satake | |
| 2016/0214386 | A1 | 7/2016 | Till | |
| 2017/0015101 | A1 | 1/2017 | Coma Vives et al. | |
| 2017/0173963 | A1 | 6/2017 | Gaston Llado et al. | |

FOREIGN PATENT DOCUMENTS

| | | | |
|---|---|---|---|
| DE | 102014225405 | A1 | 6/2016 |
| EP | 1754607 | A2 | 2/2007 |
| JP | 2001-158105 | A | 6/2001 |
| JP | 2014-168881 | | 9/2014 |
| JP | 2015-168080 | A | 9/2015 |
| JP | 2015-168210 | | 9/2015 |
| JP | 2016-124110 | A | 7/2016 |

OTHER PUBLICATIONS

International Search Report and Written Opinion dated Aug. 13, 2018 in PCT/JP2018/014609 filed on Apr. 5, 2018.

* cited by examiner

| | OVERALL VIEW | SETTING OBJECT |
|---|---|---|
| (a) DEFAULT |   |   |
| (b) CASSETTE |   |   |
| (c) CLEANING JIG |   |   |

APPARATUS FOR DISCHARGING LIQUID, METHOD FOR MAINTAINING LIQUID DISCHARGE HEAD, AND CLEANER FOR LIQUID DISCHARGE HEAD

TECHNICAL FIELD

The present invention relates to an apparatus for discharging liquid, a maintenance method for a liquid ejection head, and a cleaner for a liquid discharge head.

BACKGROUND ART

An apparatus using a liquid discharge head includes a maintenance recovery device (maintenance device) including, e.g., a wiper to wipe a nozzle surface of the liquid discharge head and a cap to cap the nozzle surface of the liquid discharge head, to perform an operation for maintaining and recovering a state of the nozzle surface (a normal maintenance operation).

For example, an apparatus is known that includes a liquid discharge head having a nozzle formation surface on which nozzles to jet liquid toward a target are formed, a support portion to support the target to be discharged with the liquid, a carriage reciprocally movable in a scanning direction in a state of holding a liquid jetting head, and a maintenance unit that is detachably attached to a maintenance area outside the support portion in the scanning direction and performs a normal maintenance operation of the liquid jetting head (PTL 1).

CITATION LIST

Patent Literature

PTL 1: JP-2014-168881-A

SUMMARY OF INVENTION

Technical Problem

Even if the nozzle surface is wiped and cleaned by a normal maintenance operation of the maintenance mechanism, adhered substances of waste liquid may be deposited over time on, e.g., an edge portion of the nozzle surface or an edge portion of a cover covering the edge portion of the nozzle surface and interfere with a liquid application member.

Since such adhered substances are firmly fixed to the edge portion of the nozzle surface or the cover, there is a problem that the solidified matter cannot be removed by the normal maintenance operation, such as wiping of the wiper.

The present invention has been made in view of the above-described problem, and an object of the present invention is to allow adhered substances to be removed from a head.

Solution to Problem

In order to solve the above-described problem, an apparatus for discharging liquid includes a liquid discharge head to discharge liquid; a holder to hold a liquid application target to which the liquid is applied; and a cleaner to clean the liquid discharge head. The cleaner is detachably attached to the holder and, with the cleaner attached to the holder being in contact with the liquid discharge head, the holder and the liquid discharge head are relatively moved to clean the liquid discharge head with the cleaner.

Advantageous Effects of Invention

According to the present invention, adhered substances of a head can be removed.

DESCRIPTION OF EMBODIMENTS

Figure 1:
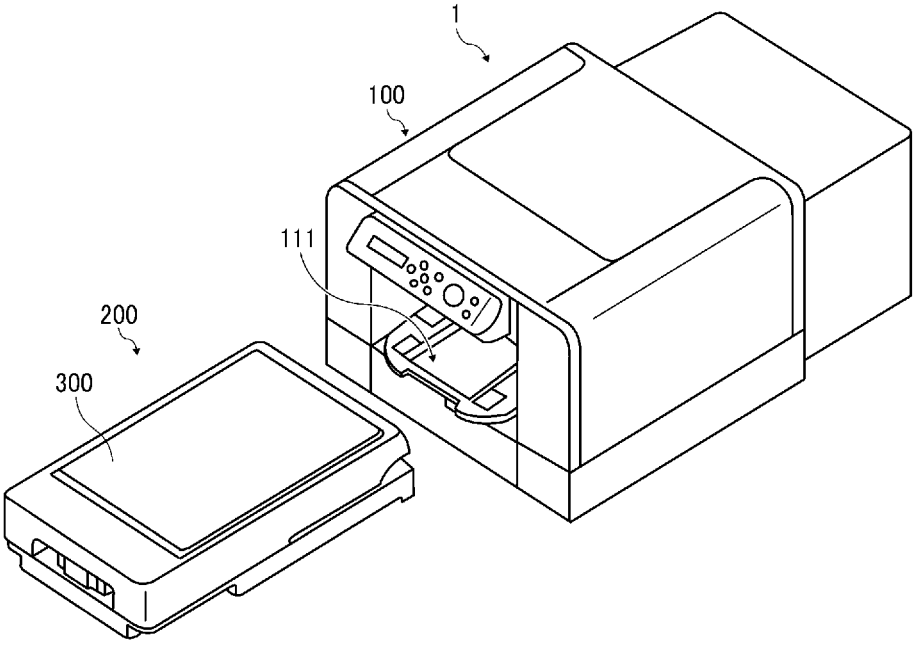
FIG. 1 is an outer perspective view of an example of an apparatus for printing a cloth (a printing apparatus) in a state in which a cassette is detached from the printing apparatus.
Figure 2:
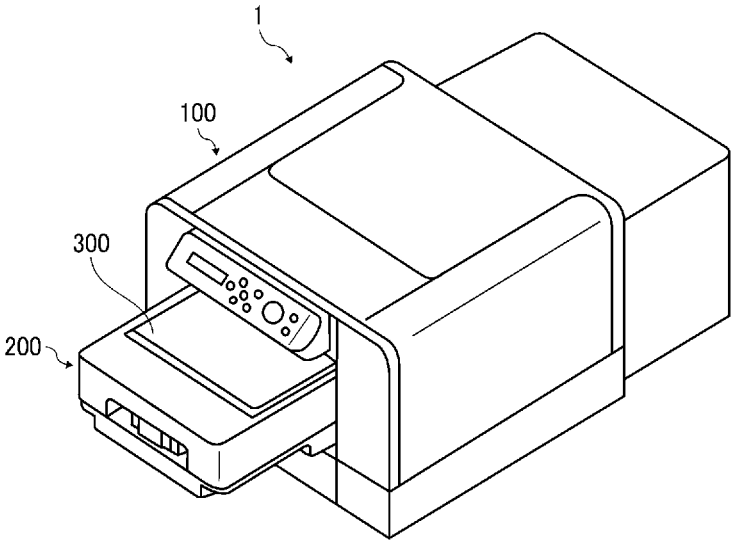
FIG. 2 is an external perspective view of the printing apparatus in a state in which the cassette is attached to the printing apparatus.
Figure 3:
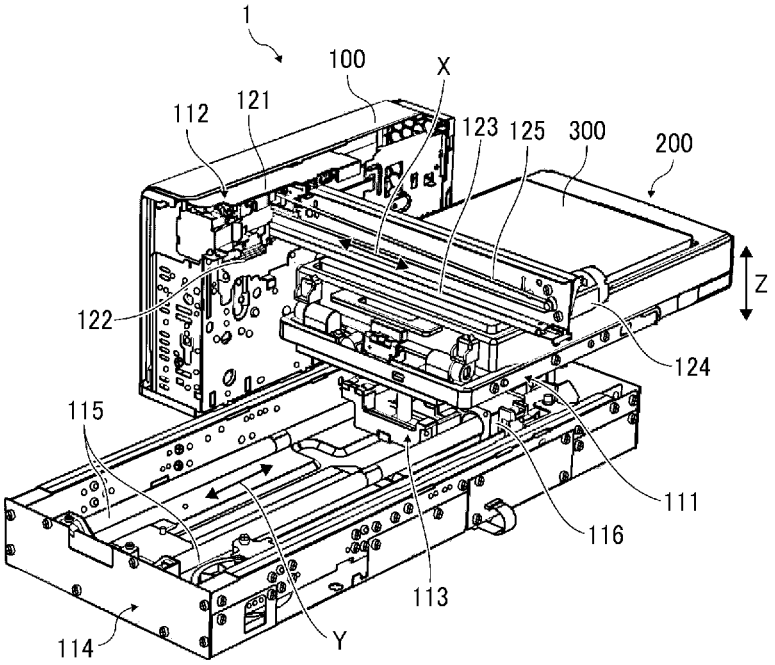
FIG. 3 is a perspective view of an overall structure of a mechanical section of the printing apparatus.
Figure 4:
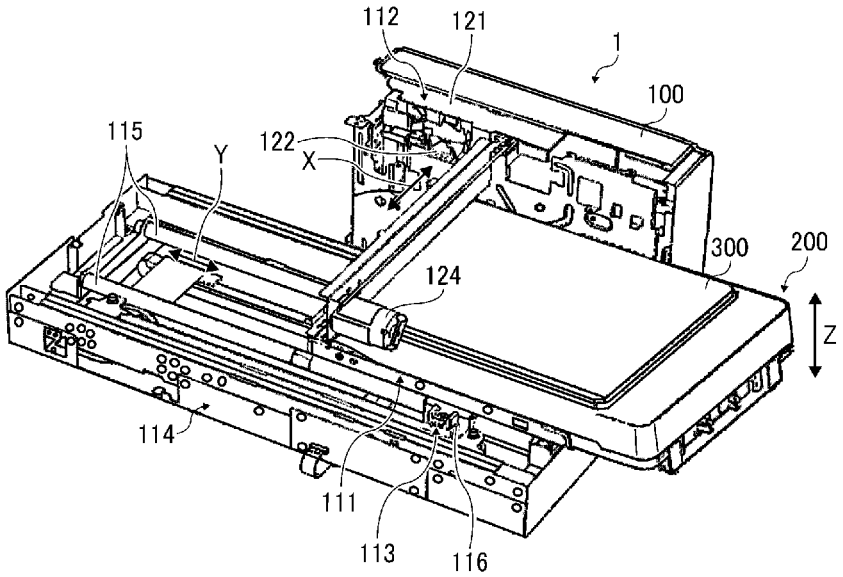
FIG. 4 is a perspective view of the mechanical section of the printing apparatus seen from a direction different from FIG. 3.

In the following, embodiments of the present invention will be described with reference to the accompanying drawings. First, an example pf a printing apparatus to print on cloth, which is an apparatus for discharging liquid according to an embodiment of the present invention, is described with reference to FIGS. 1 to 4. FIG. 1 is an outer perspective view of the printing apparatus in a state in which a cassette is detached from the printing apparatus. FIG. 2 is an external perspective view of the printing apparatus in a state in which the cassette is attached to the printing apparatus. FIG. 3 is a perspective view of an overall structure of a mechanical section of the printing apparatus. FIG. 4 is a perspective view of the mechanical section of the printing apparatus seen from a direction different from FIG. 3.

A printing apparatus 1 according to the present embodiment includes a stage 111 and a printing device 112 in an apparatus body 100. The stage 111 is a holder (receiver) to which a cassette 200 is detachably attachable. The cassette 200 is a cloth holder to hold a cloth 400 that is a liquid application target to which liquid is applied. The printing device 112 prints on the cloth 400 that is held by the cassette 200 held by the stage 111.

For example, the cloth 400 includes a piece of cloth, such as a handkerchief and towel, a fabric manufactured as clothes such as a T-shirt and a sweatshirt, and a fabric used as a part of a product such as a tote bag.

In FIG. 3, the stage 111 is a tray-shaped member disposed above a conveyor 113. The conveyor 113 is supported by the apparatus body 100 such that the conveyor 113 is movable in a direction (feed direction) indicated by arrow Y (hereinafter, Y direction). Here, conveyance guides 115 are arranged along the Y direction in a bottom casing 114 of the apparatus body 100. Slider portions 116 of the conveyor 113 are movably held by the conveyance guides 115. The stage 111 is disposed to be movable up and down along a direction indicated by arrow Z in FIG. 3 (hereinafter, Z direction) with respect to the conveyor 113. The stage 111 is raised and lowered by an elevating mechanism. Note that, instead of raising and lowering the stage 111, the entire printing device 112 may be raised and lowered.

The printing device 112 includes a carriage 121 and a head 122. The carriage 121 is movable in a direction (main scanning direction) indicated by arrow X (hereinafter, X direction) with respect to the stage 111. The head 122 is a liquid discharge head mounted on the carriage 121. The carriage 121 is movably held with a guide 123 disposed along the X direction. A driving motor 124 moves the carriage 121 back and forth in the X direction via a scanning assembly, such as a timing belt 125. The head 122 discharges ink onto a surface of cloth using a liquid discharge head to form an image.

In the printing apparatus 1, with the cloth 400 set on a platen 300 of the cassette 200, the cassette 200 is mounted and held on the stage 111 in the apparatus body 100. As the movement of the stage 111 in the Y direction and the reciprocal movement of the head 122 in the X direction are repeated, the head 122 prints a desired image on the cloth 400.

Figure 5:
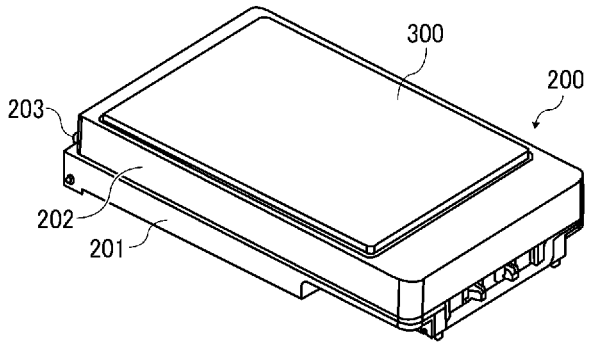
FIG. 5 is a perspective view of an example of the cassette.
Figure 6:
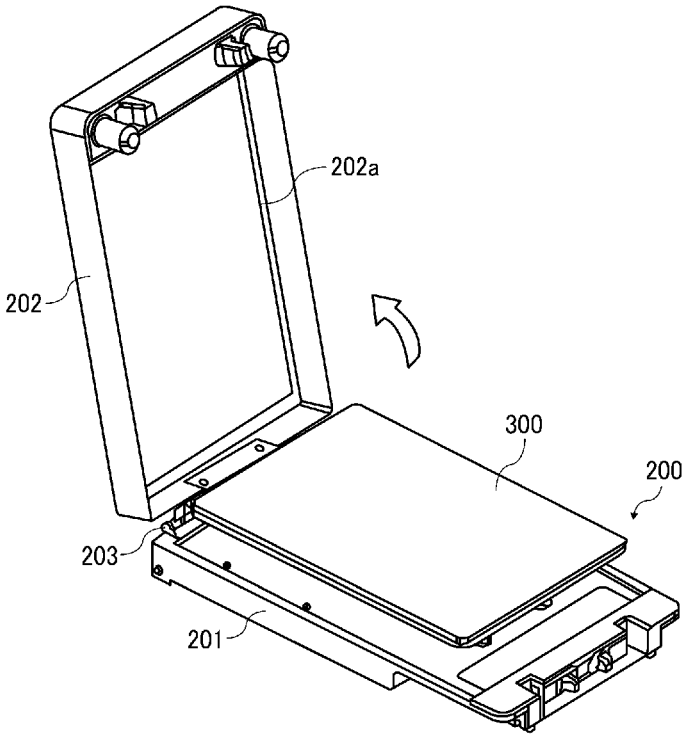
FIG. 6 is a perspective view of a state in which an outer peripheral cover of the cassette of FIG. 5 is opened.
Figure 7:
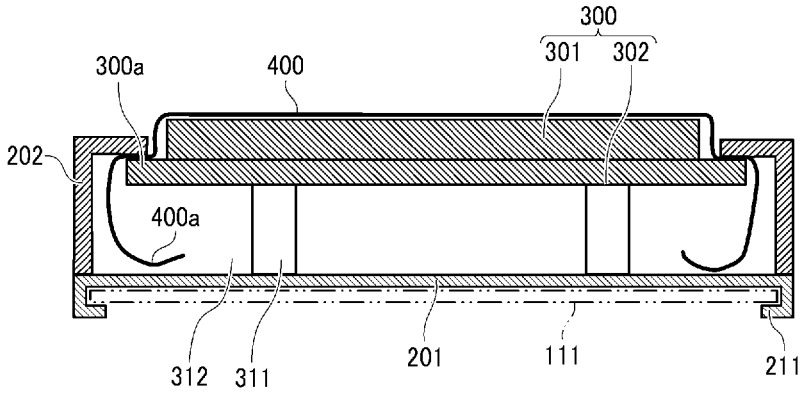
FIG. 7 is a cross-sectional view of the cassette of FIG. 5 cut along a short direction of the cassette.

Next, the outline of the cassette is described with reference also to FIGS. 5 to 7. FIG. 5 is a perspective view of an example of the cassette. FIG. 6 is a perspective view of a state in which an outer peripheral cover of the cassette of FIG. 5 is opened. FIG. 7 is a cross-sectional view of the cassette of FIG. 5 cut along a short direction of the cassette.

The cassette 200 includes a cassette base 201 that is a tray base member and the platen 300 to hold a portion to be printed of the cloth 400 in a flat state.

As illustrated in FIG. 7, the platen 300 includes a platen structure 302 and a heat insulator 301. The heat insulator 301 constitutes a surface to hold the cloth 400 in a flat state. The heat insulator 301 has heat resistance against heating by a heating device.

As illustrated in FIGS. 5 and 6, the cassette 200 includes a platen peripheral cover 202 and a hinge 203. The platen peripheral cover 202 serving as an outer peripheral cover is attached to the cassette base 201 through the hinge 203 such that the platen peripheral cover 202 can open in a direction indicated by an arrow in FIG. 6. The platen peripheral cover 202 has an opening **202*a* in a portion corresponding to the platen 300 and presses the cloth 400 between the platen peripheral cover 202 and a flange portion 300*a* that is an outer peripheral portion of the platen 300**.

Guide rails 211 are disposed at both ends of the cassette base 201 in a direction perpendicular to an attachment-detachment direction in which the cassette 200 is attached to or detached from the stage 111 of the apparatus body 100. The guide rails 211 movably engage both ends of the stage 111 in the direction perpendicular to the attachment-detachment direction such that the guide rails 211 hold the ends of the stage 111.

The platen 300 is supported by supports 311 with respect to the cassette base 201 and an accommodation chamber 312 is formed between the platen 300 and the cassette base 201, to accommodate a surplus portion **400*a* of the cloth 400. For example, the surplus portion 400*a*** may be sleeves, a neck, a hem, and the like of a T-shirt, if an image is printed on a front of the T-shirt.

The platen 300 is removably attached to the cassette base 201 and is replaceable. Accordingly, a plurality of platens 300 can be prepared so that, during printing operation on a cloth on one platen 300, another cloth can be wound around another platen 300. By simply replacing the platen 300 after printing and fixing, printing of the next cloth can be promptly started.

In order to place the cloth 400 on the cassette 200, a user opens the platen peripheral cover 202 as illustrated in FIG. 6 and places the cloth 400 on the platen 300. In a state in which the accommodation chamber 312 accommodates the surplus portion **400*a* of the cloth 400 as illustrated in FIG. 7, the user closes the platen peripheral cover 202 as illustrated in FIG. 5**.

When printing on the cloth 400, the cassette 200 in which the cloth 400 is set is mounted (set) on the stage 111 of the apparatus body 100 of the printing apparatus 1. At this time, the cassette 200 can be attached to the stage 111 from a direction of movement of the stage 111. Accordingly, the stage 111 is not entirely exposed from the apparatus body 100, thus allowing the printing apparatus 1 to be downsized compared to a configuration in which the user vertically attaches the cassette 200 onto the stage 111.

As described above, the user can remove the cassette 200 entirely from the apparatus body 100, thus facilitating setting of the cloth 400 as a print target onto the platen 300.

After completion of printing by the printing apparatus 1, the cassette 200 can be set in an apparatus that heats cloth according to an embodiment of the present invention while holding the cloth 400, to heat the cloth 400 on which the image has been printed and fix the image on the cloth 400.

Figure 8A:
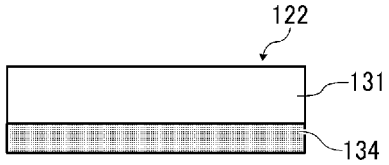
FIGS. 8A to 8C (FIG. 8) are external views of an example of a liquid discharge head.
Figure 8B:
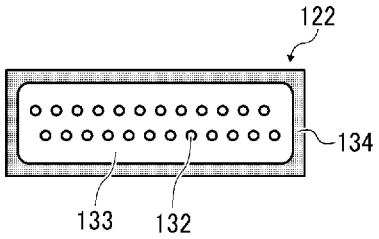
Figure 8C:
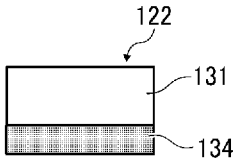
Figure 9:
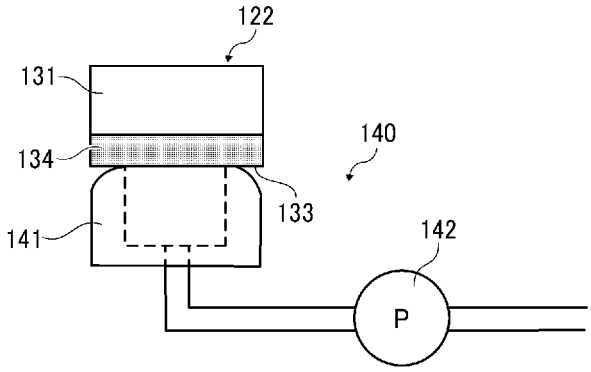
FIG. 9 is an illustration of a suction cap of a maintenance recovery device.
Figure 10:
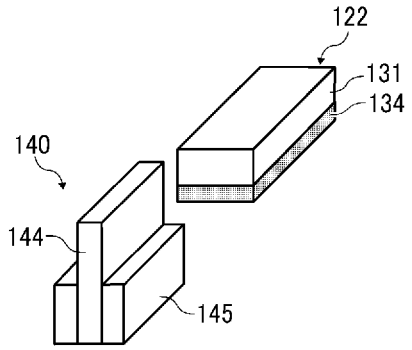
FIG. 10 is an illustration of a wiper of the maintenance recovery device.

Next, an example of the liquid discharge head and the maintenance recovery device is described with reference to FIGS. 8A to 10. FIGS. 8A to 8C are external views of an example of the liquid discharge head. FIG. 9 is an illustration of a suction cap of a maintenance recovery device. FIG. 10 is an illustration of a wiper of the maintenance recovery device.

The head 122, which is a liquid discharge head, includes a head body 131 and a cover 134. The head body 131 has a nozzle surface 133 in which nozzles 132 to discharge liquid are formed. The cover 134 is attached to the head body 131, to cover a peripheral portion of the nozzle surface 133.

The maintenance recovery device 140 includes a suction cap 141 to which a suction pump 142 is connected, and a wiper 144 held by a wiper holder 145.

Figure 11:
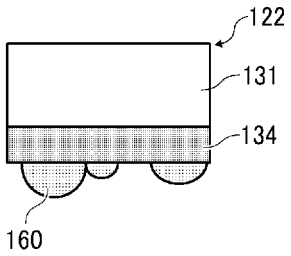
FIG. 11 is an illustration of a state of the liquid discharge head after suction of the liquid discharge head with the maintenance recovery device.

Next, the maintenance recovery operation of the head by the maintenance recovery device is described with reference to FIGS. 11 to 13. FIG. 11 is an illustration of a state of the head after suction of the head. FIGS. 12A to 12D are illustrations of wiping operation. FIG. 13 is an illustration of generation of adhered substance to the head.

In the maintenance recovery operation of the head 122, for example, as illustrated in FIG. 9, the suction pump 142 is activated with the nozzle surface 133 of the head 122 capped with the suction cap 141, to sucks and discharges liquid from the nozzles 132 (head suction or nozzle suction). As a result of the head suction, as illustrated in FIG. 11, waste liquid 160 remains on the nozzle surface 133 of the head 122 or the surface of the cover 134.

Figure 12A:
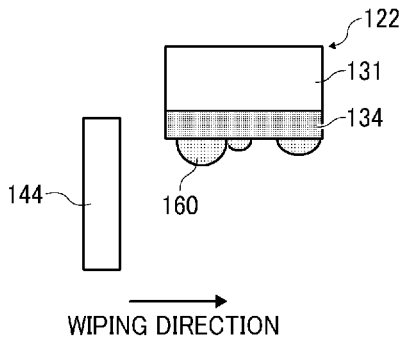
FIGS. 12A to 12D (FIG. 12) are illustrations of wiping operation of the maintenance recovery device.
Figure 12B:
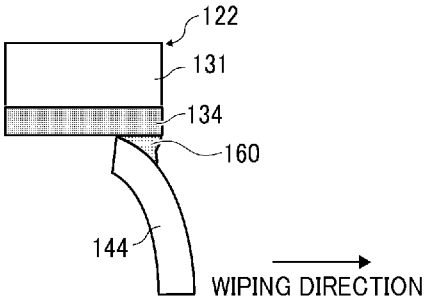

Then, as illustrated in FIGS. 12A to 12D, the wiper 144 performs a wiping operation to wipe the nozzle surface 133. In the wiping operation, as illustrated in FIG. 12A, the wiper 144 is raised and, as illustrated in FIG. 12B, is relatively moved in a direction (wiping direction) indicated by an arrow to wipe the nozzle surface 133 and the waste liquid 160 of the cover 134.

Figure 12C:
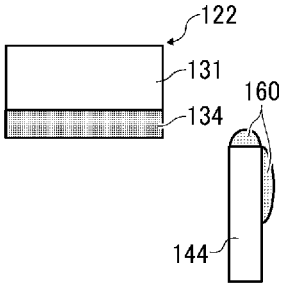
Figure 12D:
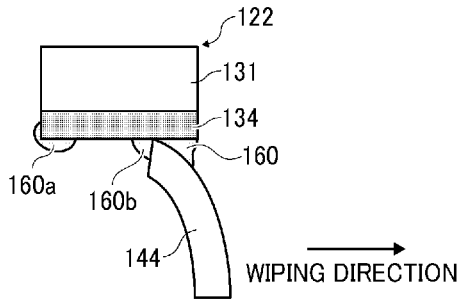
Figure 13:
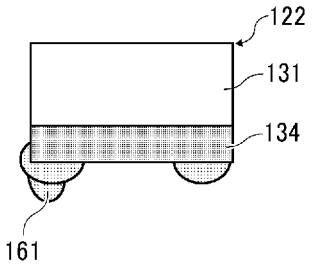
FIG. 13 is an illustration of generation of adhered substance to the liquid discharge head.

After the end of wiping, as illustrated in FIG. 12C, the wiped waste liquid 160 adheres to the wiper 144. If the next wiping is performed in the state illustrated in FIG. 12C, as illustrated in FIG. 12D, the wiper 144 would start wiping from the outside of the cover 134, so that the waste liquid 160 adhering to the wiper 144 would be transferred to the cover 134 of the head 122. On the wiping start side, waste liquid (waste liquid 160*a*) is likely to be transferred to an area including a side face of the cover 134. On the wiping end side, waste liquid (waste liquid 160*b*) is likely to be transferred to a step portion between the nozzle surface 133 and the cover 134.

When the waste liquid 160 transferred to the cover 134 is left to stand, the waste liquid 160 is dried and adhered. Since the adhered waste liquid 160 cannot be scraped off by the wiping of the wiper 144, as illustrated in FIG. 13, the adhered waste liquid 160 becomes a gradually-deposited adhered substance 161 and comes into contact with a liquid application target (for example, the above-described cloth 400), which may cause a failure such as stains.

Figure 14A:
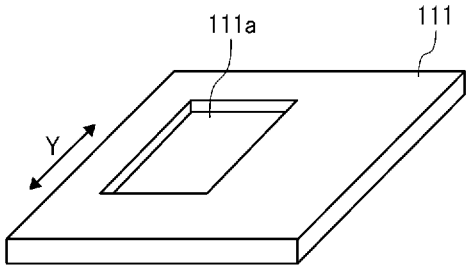
FIGS. 14A and 14B (FIG. 14) are perspective views for illustrating a first embodiment of the present invention.
Figure 14B:
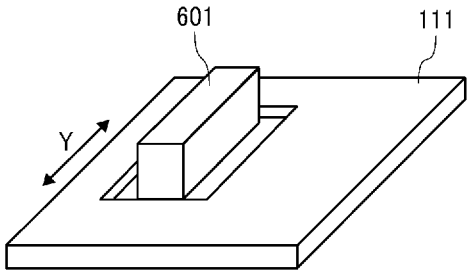

Next, a first embodiment of the present invention is described with reference to FIGS. 14A and 14B. FIGS. 14A and 14B are perspective views of the first embodiment. FIG. 14A illustrates a preset state before the cleaner is attached (set) to the receiver. FIG. 14B illustrates a state after the cleaner is attached (set) to the receiver.

In the present embodiment, the stage 111 includes a cleaner attachment portion 111*a*. Instead of the cassette 200 to hold the cloth 400, a cleaner 601 is detachably attached to the stage 111. The cleaner 601 may be formed of a porous member, such as a sponge. The cleaner 601 is arranged with the Y direction being a longitudinal direction of the cleaner 601.

The stage 111 and the cleaner 601 may be secured by, for example, magnetic coupling. Alternatively, the cleaner 601 can be slid from the Y direction to fit into the stage 111.

Figure 15A:
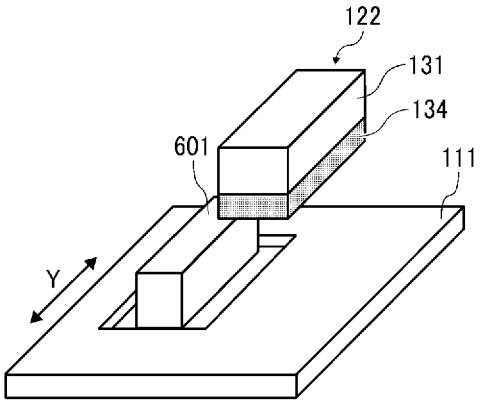
FIGS. 15A and 15B (FIG. 15) are perspective views for illustrating a cleaning operation (maintenance method) in the first embodiment.
Figure 15B:
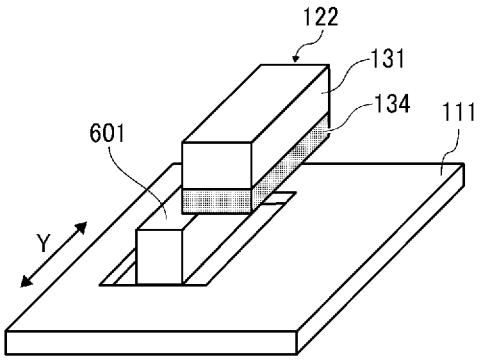
Figure 16A:
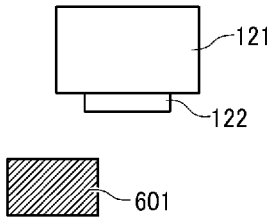
FIGS. 16A to 16C (FIG. 16) are front views for illustrating the cleaning operation in the first embodiment.
Figure 16B:
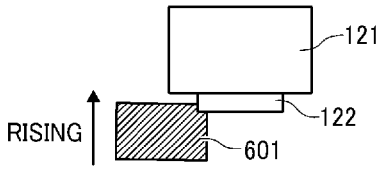
Figure 16C:
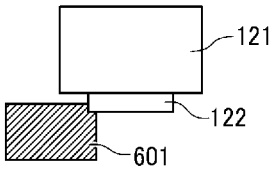
Figure 17A:
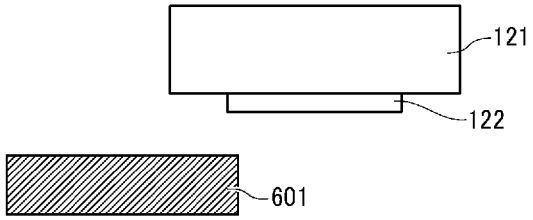
FIGS. 17A to 17C (FIG. 17) are side views for illustrating the cleaning operation in the first embodiment.
Figure 17B:
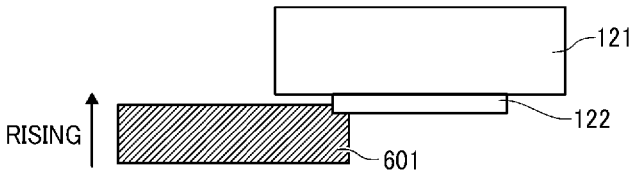
Figure 17C:
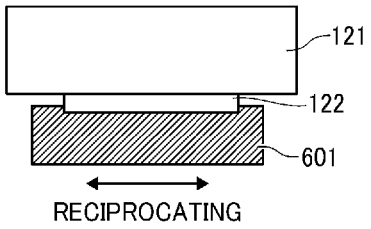

Next, the cleaning operation (maintenance method) in the first embodiment is described with reference to FIGS. 15A to 17C. FIGS. 15A and 15B are perspective views of the head and the cleaner in the cleaning operation in the first embodiment. FIGS. 16A to 16C are front views of the head and the cleaner in the cleaning operation in the first embodiment. FIGS. 17A to 17C are side views of the head and the cleaner in the cleaning operation in the first embodiment.

When cleaning (maintenance) of the head 122 is performed, the carriage 121 is moved in the X direction with the cleaner 601 set on (attached to) the stage 111. As illustrated in FIGS. 15A and 16A, the cleaner 601 is moved to a position to contact one edge portion of the head 122 along a longitudinal direction of the head 122. Then, as illustrated in FIGS. 16B and 17B, the stage 111 is raised so that the cleaner 601 contacts the one edge portion of the head 122 along the longitudinal direction of the head 122.

Then, as illustrated in FIGS. 15B, 16C, and 17C, the stage 111 is reciprocated one or a plurality of times in the Y direction, to scrape off and remove, with the cleaner 601, adhered substance 161 adhering to the one edge portion of the head 122 along the longitudinal direction of the head 122. At this time, the cleaner 601 can simultaneously contact a side surface and the nozzle surface side of the cover 134 and can remove not only the adhered substance 161 on the nozzle surface side but also the adhered substance 161 on the side surface.

Next, the carriage 121 is moved in the X direction, the cleaner 601 is moved to a position to contact another edge portion along the longitudinal direction of the head 122. The stage 111 is raised and moved in the Y direction to scrape off and remove adhered substance 161 adhering to the another edge portion along the longitudinal direction of the head 122.

As described above, in a state in which the cleaner 601 is attached to the stage 111 instead of the cassette 200 and the cleaner 601 is in contact with the edge portion of the head 122 in the longitudinal direction of the head 122, the stage 111 and the head 122 are moved relative to each other to rub the cleaner 601 against the edge portion of the head 122 along the longitudinal direction of the head 122 to remove the adhered substance 161.

Thus, adhered substance of the head 122 can be reliably cleaned and removed.

In such a case, since the longitudinal direction of the cleaner 601 corresponds to the Y direction which is the longitudinal direction of the head 122, the wiping distance can be increased as compared with, e.g., the wiper, thus enhancing the cleaning effect. Further, even more strongly adhered substance can be removed by increasing the number of times of reciprocation of the cleaner 601.

Since cleaning (maintenance) by the cleaner 601 is not ordinary maintenance, usually, the cleaner 601 can be detached from the stage 111 and stored in an arbitrary place. In addition, since the receiver (stage) to move the liquid application target to which liquid is applied is used to move the cleaner 601, no special drive source is required and the apparatus size is not increased. Further, since a portion of the cleaner 601 to contact the head 122 is configured to be replaceable, cleaning can be constantly performed with the cleaner 601 in a normal state and the cleaning efficiency can be enhanced.

Figure 18:
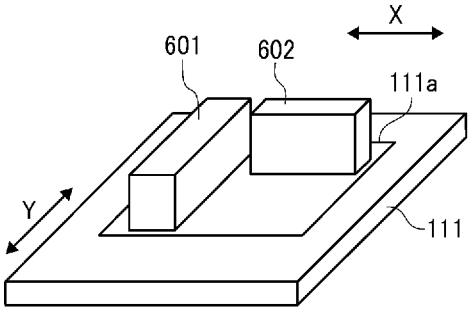
FIG. 18 is a perspective view for illustrating a second embodiment of the present invention.

Next, a second embodiment of the present invention is described with reference to FIG. 18. FIG. 18 is a perspective view of the second embodiment.

In the present embodiment, the stage 111 includes the cleaner attachment portion 111*a*. Instead of the cassette 200, the cleaner 601 and a cleaner 602 can be detachably attached to the stage 111. Each of the cleaner 601 and the cleaner 602 may be formed of a porous member, such as a sponge. The cleaner 601 is arranged with the Y direction being a longitudinal direction of the cleaner 601. The cleaner 602 is arranged with the X direction being a longitudinal direction of the cleaner 602.

Figure 19A:
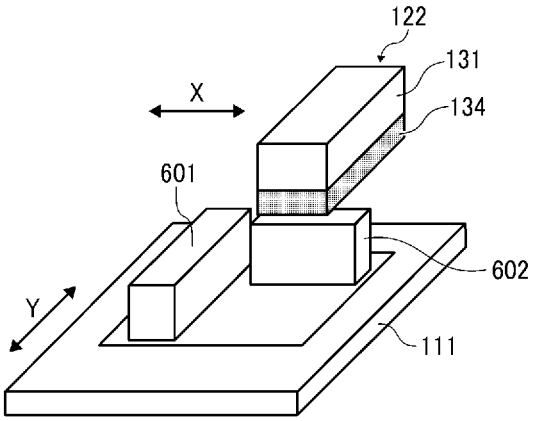
FIGS. 19A and 19B (FIG. 19) are perspective views for illustrating the cleaning operation (maintenance method) in the second embodiment.
Figure 19B:
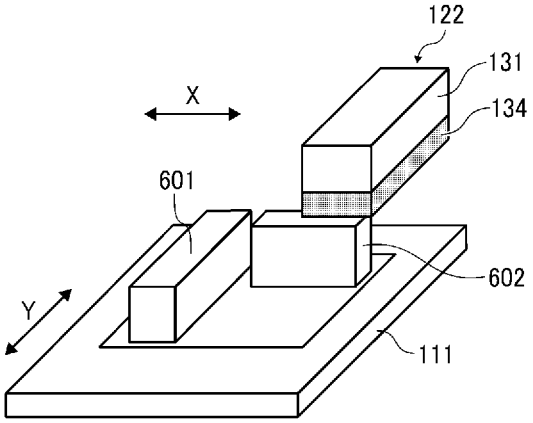

Next, the cleaning operation (maintenance method) in the second embodiment is described with reference to FIGS. 19A and 19B. FIGS. 19A and 19B are perspective views of the head and the cleaners in the cleaning operation in the second embodiment.

When cleaning (maintenance) is performed on the head 122, as in the first embodiment, the cleaner 601 is set on the stage 111, and the adhered substance 161 adhered to an edge portion of the head 122 along the longitudinal direction of the head 122 is scraped off and removed by the cleaner 601.

Next, as illustrated in FIG. 19A, the stage 111 is moved in the Y direction to a position at which the cleaner 602 contacts one edge portion of the head 122 along a short direction of the head 122. Then, the stage 111 is raised, and the cleaner 602 is brought into contact with the one edge portion of the head 122 along the short direction of the head 122.

Then, as illustrated in FIGS. 19A and 19B, the carriage 121 is reciprocated one or a plurality of times in the X direction, to scrape off and remove, with the cleaner 602, the adhered substance 161 adhering to the one edge portion of the head 122 along the short direction of the head 122.

Then, the stage 111 is moved to a position to contact another edge portion along the short direction of the head 122. The adhered substance 161 adhering to the another edge portion of the head 122 along the short direction of the head 122 is scraped off and removed with the cleaner 602.

As described above, in the present embodiment, a first operation of cleaning the longitudinal direction of the head 122 with the cleaner 601 and a second operation of cleaning the short direction of the head 122 by the cleaner 602 are performed to clean the head 122.

Figure 20:
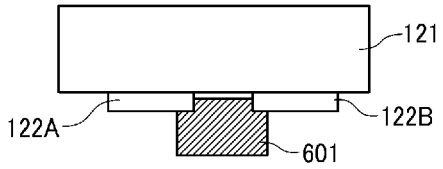
FIG. 20 is a front view for illustrating the third embodiment.

Next, a third embodiment of the present invention is described with reference to FIG. 20. FIG. 20 is a front view of the third embodiment.

In the present embodiment, two heads 122A and 122B are disposed at a predetermined interval on the carriage 121.

Hence, when cleaning is performed by the cleaner 601, the cleaner 601 is reciprocated between the heads 122A and 122B with the cleaner 601 being in contact with the heads 122A and 122B at the same time.

Such a configuration can shorten the cleaning time as compared with a case in which the cleaner 601 separately cleans the head 122A and the 122B.

Figure 21:
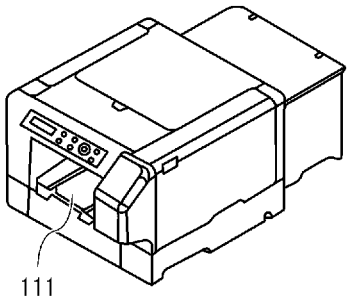
FIG. 21 is an illustration of different modes of the printing apparatus according to a fourth embodiment of the present invention.
Figure 21:
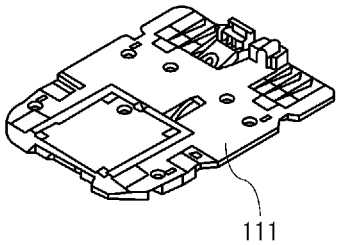
Figure 21:
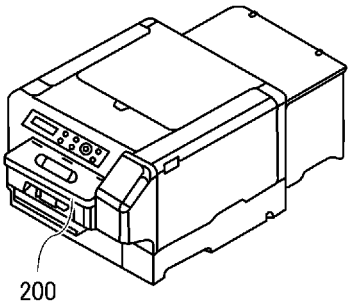
Figure 21:
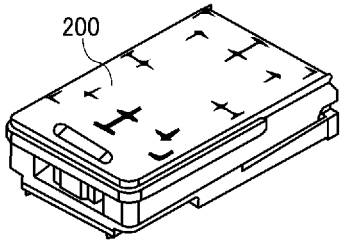
Figure 21:
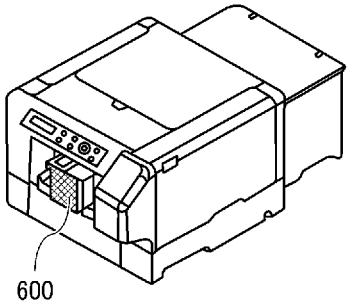
Figure 21:
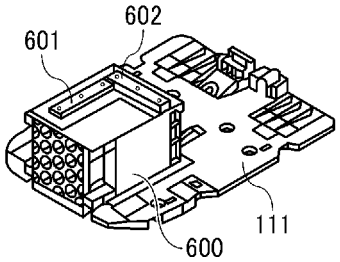

Next, a fourth embodiment of the present invention is described with reference to FIG. 21. FIG. 21 is an illustration of different modes of the printing apparatus according to the fourth embodiment.

As illustrated in (a) of FIG. 21, in a default state, the printing apparatus 1 is in a state in which no component is attached to the stage 111. When the printing apparatus 1 prints on the cloth 400, as illustrated in (b) of FIG. 21, the cassette 200 is set on (attached to) the stage 111. When cleaning is performed on the head 122, as illustrated in (c) of FIG. 21, instead of the cassette 200, a cleaning jig 600 as a detachably-attachable cleaner is set on (attached to) the stage 111.

In the cleaning jig 600, the cleaners 601 and 602, which are parts to contact the head 122 in the present embodiment, are disposed to be replaceable. The cleaner 601 is arranged so that the Y direction along the longitudinal direction of the head 122 corresponds to the longitudinal direction of the cleaner 601. The cleaner 602 is arranged so that the X direction along the short direction of the head 122 corresponds to the longitudinal direction of the cleaner 602. Each of the cleaners 601 and 602 is formed of a porous member, such as a sponge.

Also in the present embodiment, cleaning of the head 122 can be performed in the same manner as in the second embodiment.

That is, when cleaning is performed on the head 122, the cleaning jig 600 is set on the stage 111 instead of the cassette 200. Then, the cleaner 601 cleans the edge portion of the head 122 along the longitudinal direction of the head 122, and the cleaner 602 cleans the edge portion along the short direction of the head 122.

In the above-described embodiments, the printing apparatus as the apparatus for discharging liquid onto cloth as a liquid application target (member) is described. However, the apparatus for discharging liquid is not limited to such an example.

In the present disclosure, discharged liquid is not limited to a particular liquid as long as the liquid has a viscosity or surface tension to be discharged from a head. However, preferably, the viscosity of the liquid is not greater than 30 millipascal-seconds under ordinary temperature and ordinary pressure or by heating or cooling. Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant. Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

Examples of an energy source for generating energy to discharge liquid include a piezoelectric actuator (a laminated piezoelectric element or a thin-film piezoelectric element), a thermal actuator that employs a thermoelectric conversion element, such as a heating resistor (element), and an electrostatic actuator including a diaphragm and opposed electrodes.

The term "apparatus for discharging liquid" can also include means relating to feeding, conveying, ejecting, which can adhere liquid, pretreatment apparatus, post-processing apparatus, and the like.

The "apparatus for discharging liquid" may be, for example, an image forming apparatus to form an image on a sheet by discharging ink, a three-dimensional fabricating apparatus (solid-object fabricating apparatus) to discharge a fabrication liquid to a powder layer in which powder material is formed in layers, so as to form a three-dimensional fabrication object (solid fabrication object), or a three-dimensional fabricating apparatus to discharge a model material and a support material onto a stage to fabricate materials in layers to form a three-dimensional object.

The apparatus for discharging liquid is not limited to an apparatus to discharge liquid to visualize meaningful images, such as letters or figures. For example, the apparatus for discharging liquid includes an apparatus to form meaningless images, such as meaningless patterns, or fabricate three-dimensional images.

The above-described term "material onto which liquid adheres" denotes, for example, a material or a medium onto which liquid is adhered at least temporarily, a material or a medium onto which liquid is adhered and fixed, or a material or a medium onto which liquid is adhered and into which the liquid permeates. Examples of the "material onto which liquid adheres" include recording media such as a paper sheet, recording paper, and a recording sheet of paper, film, and cloth, electronic components such as an electronic substrate and a piezoelectric element, and media such as a powder layer, an organ model, and a testing cell. The "material onto which liquid adheres" includes any material on which liquid adheres unless particularly limited.

The apparatus for discharging liquid may be an apparatus to relatively move a liquid discharge head and a material on which liquid can be adhered. However, the apparatus for discharging liquid is not limited to such an apparatus. The "apparatus for discharging liquid" may be, for example, a serial-type apparatus to move a liquid discharge head relative to a sheet material or a line-type apparatus that does not move a liquid discharge head relative to a sheet material.

REFERENCE SIGNS LIST

1 Printing apparatus
100 Apparatus body of printing apparatus
111 Stage (holder or receiver)
121 Carriage
122 head
200 Cassette (cloth holder)
300 Platen
400 Cloth
600 Cleaning jig (cleaner)
601 Cleaner
602 Cleaner

The invention claimed is:

1. An apparatus for discharging liquid, the apparatus comprising:

a liquid discharge head to discharge liquid;

a cassette to hold a liquid application target to which the liquid is applied during printing, a holder to hold the cassette, the cassette being detachably attached to the holder, the holder having an attachment portion at which a cleaner attaches during cleaning, the attachment portion being arranged on a portion of the holder covered by the cassette when the cassette is attached during printing; and the cleaner to clean the liquid discharge head, wherein the cleaner is detachably attached to the holder at the attachment portion during cleaning and not attached during printing, and wherein, with the cleaner attached to the holder and in contact with the liquid discharge head, the holder and the liquid discharge head are relatively moved to clean the liquid discharge head with the cleaner.

2. The apparatus according to claim 1, wherein the cleaner cleans an edge portion of the liquid discharge head.

3. The apparatus according to claim 1, wherein the cleaner performs a first operation of cleaning the liquid discharge head in a longitudinal direction of the liquid discharge head and a second operation of cleaning the liquid discharge head along a short direction of the liquid discharge head.

4. The apparatus according to claim 1, wherein the holder and the liquid discharge head are relatively moved a plurality of times.

5. The apparatus according to claim 1, wherein a portion of the cleaner to contact the liquid discharge head is made of a porous member.

6. The apparatus according to claim 1, wherein a portion of the cleaner to contact the liquid discharge head is replaceable.

7. The apparatus according to claim 1, further comprising another liquid discharge head disposed at an interval from the liquid discharge head, wherein, with the holder is in contact with both the liquid discharge head and said another liquid discharge head, the holder and a pair of the liquid discharge head and said another liquid discharge head are relatively moved.

8. The apparatus according to claim 1, further comprising a cloth holder to hold a cloth, wherein the cloth holder is detachably attached to the holder.

9. The apparatus of claim 1, Wherein the liquid discharge head is movable in a main scanning direction perpendicular to a longitudinal direction of the liquid discharge head.

10. The apparatus of claim 1, wherein the cleaner is attached to the holder by a magnetic coupling.

11. A method for maintaining a liquid discharge head to discharge liquid, the method comprising:

attaching a cleaner to a holder that holds a liquid application target to which the liquid is applied during printing, the holder having an attachment portion at Which the cleaner attaches during cleaning and the holder holding a cassette during printing, the attachment portion being arranged on a portion of the holder covered by the cassette when the cassette is attached during printing;

causing the cleaner attached to the holder to come into contact with the liquid discharge head;

moving the holder and the liquid discharge head relatively to clean the liquid discharge head with the cleaner;

detaching the cleaner and attaching the cassette to the holder; and performing printing onto the liquid application target using the liquid discharge head.

12. The method of claim 11, further comprising:

moving the liquid discharge head in a main scanning direction to align with the cleaner; and moving the liquid discharge head in a longitudinal direction of the discharge head to clean the liquid discharge head with the cleaner.

13. The method of claim 11, wherein the causing step comprises moving the holder in a vertical direction to contact the liquid discharge head.

14. A cleaner for a liquid discharge head of an apparatus for discharging liquid, wherein the cleaner is detachably attachable to a holder of the apparatus that holds a liquid application target to which the liquid is applied during printing, the holder having an attachment portion at which the cleaner attaches during cleaning and the holder holding a cassette during printing, the attachment portion being arranged on a portion of the holder covered by the cassette when the cassette is attached during printing, wherein the cleaner cleans the liquid discharge head as the holder and the liquid discharge head are relatively moved with the cleaner attached to the holder being in contact with the liquid discharge head, and wherein the cleaner is detachably attached to the holder at the attachment portion during cleaning and not attached during printing.

* * * * *